US005117815A

United States Patent [19]

Gentry et al.

[11] Patent Number: 5,117,815

[45] Date of Patent: Jun. 2, 1992

[54] MASSAGER

[75] Inventors: Jefferson L. Gentry, Deerfield; Peter J. Calderaro, Elk Grove Village, both of Ill.

[73] Assignee: Associated Mills Inc., Chicago, Ill.

[21] Appl. No.: 606,133

[22] Filed: Oct. 31, 1990

[51] Int. Cl.[5] ..... A61H 1/00

[52] U.S. Cl. ..... 128/36; 128/361; 128/62 R; 128/44

[58] Field of Search ..... 128/32-36, 128/42-46, 62 R, 61; 403/55, 59, 75, 83, 84, 92, 103, 129

[56] References Cited

U.S. PATENT DOCUMENTS 3,710,785 1/1973 Hilger ..... 128/36
3,856,002 12/1974 Matsumoto ..... 128/62 R X
4,604,993 8/1986 Moriwaki et al. ..... 128/54 X
4,825,853 5/1989 Iwamoto et al. ..... 128/36
4,827,551 5/1989 Maser et al. ..... 128/56 X
4,846,158 7/1989 Teranishi ..... 128/36
4,958,628 9/1990 Iwamoto et al. ..... 128/36

*Primary Examiner*—Robert A. Hafer
*Assistant Examiner*—Brian E. Hanlon
*Attorney, Agent, or Firm*—Laff, Whitesel, Conte & Saret

[57] ABSTRACT

A wand massager has an elongated handle with two parts pivotally joined together. The pivot is offset at an angle relative to the elognation so that the handle may be given a plurality of angular configuration ranging from straight to an angle of about 150°. The handle terminates at one end in a disk having a thickness which provides an end face plate and a peripheral surface which is substantially perpendicular to the face plate at the end of the disk. The flat surface of the end plate and the peripheral surface having a plurality of different areas for giving a plurality of different massaging effects.

20 Claims, 4 Drawing Sheets

MASSAGER

This invention relates to massagers and more particularly, to wand massagers having adjustable positioning of a vibrating head.

Massagers are vibrating devices having many uses, some of which are to be held against the body in order to improve blood circulation, reduce tension, relax muscles, and the like. A wand massager has a vibrating head mounted on an end of a relatively long handle which enables a person to apply the vibrations to himself. However, there is no one shape for a handle which will enable a person to comfortably reach all parts of his body. Therefore, it is desirable to provide a handle with an adjustable shape so that it may be twisted into different configurations for reaching different parts of the body. The user should have the ability to securely adjust the handle quickly and easily.

Another consideration is the shape of the vibrating head which comes into contact with the human body. When a professional masseur gives a massage, he commonly uses different configurations of his hands for applying body pressure in different ways depending upon the part of the body being massaged and the condition or pain of that body part. Sometimes he uses his finger tips, sometimes the heel of his hand, etc. If a similar effect is to be achieved by a wand massager, the vibrating head should have at least some variety of shapes which can approximate the effects produced by the masseur. Moreover, the adjustable handle should have configurations which positions the vibrating head with any selected one of these shapes in a desired orientation and at a proper body part.

Still another consideration is the degree of firmness which the massager presents to the surface of the body. The fingers, heel of the hand, balled fist, etc. of the masseur present different textures and sensations to the body. The masseur shapes his hands to follow the contours of the body and to apply pressure and vibration to spots which relieve the hurt and pain. It would be good to approximate these features with the vibrating head of a wand massager.

Finally, a consideration is the comfort and convenience of the user of the massager. This feature has to do with the ability of the user to hold the massager without having it shake itself out of his hands, especially when they are damp or impaired, or when with the user must reach places without having to become a contortionist. Since one often uses a massager while in pain, it should be easy to use even when the user is in considerable pain.

Accordingly, an object of the invention is to provide new and improved wand massagers. Here, an object is to provide wand massagers with a number of optional uses, positions, and alternative surfaces. In this connection, an object is to provide a vibrating head with a number of alternative surfaces textures which may be selected and then made to accurately follow body contours.

Another object is to provide a wand massager which may be alternatively used with either a battery or commercial power. Here, an object is to provide a massager which may safely be used on battery while in damp or wet environments where commercial power might present a safety hazard.

In keeping with an aspect of the invention, these and other objects may be accomplished by a wand massager having a vibrating head on an end of a handle. An angularly offset pivoting section enables the handle to be adjusted between a straight or an angular offset position, with a plurality of detent indexed angles in between. A flexible bellows is included in the handle to enable the vibrating head to flex and depart slightly from the selected angle in order to follow the contours of the body. The vibrating head has a somewhat disk shape with a flat end surface set perpendicular to the elongated axis of the handle. Five different contours are distributed around the periphery and across the end surface of the disk in order to provide different massage effects. The handle has a grip which is covered with soft foam so that a person with impaired or damp hands may hold it with greater ease and with a reduced chance of dropping it.

A preferred embodiment of the invention is shown in the attached drawing, wherein.

Figure 1:
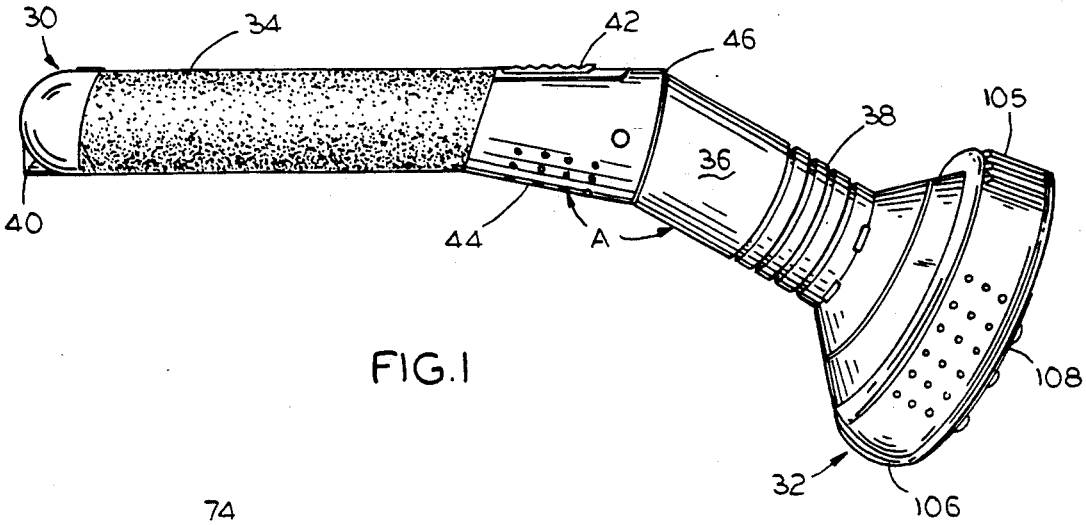
FIG. 1 is a side view of the massager with the handle set at a maximum angle.

The inventive massager (FIG. 1) comprises a handle 30 having a disk shaped vibrating head 32 on one end thereof. The handle 30 has three parts: a straight tubular grip 34, an offset part 36, and a flexible bellows 38. The grip 34 is preferably covered in a soft sponge elastomer which enables the user to securely hold the massager during operation even if the user has impaired hand motion or damp hands. In one embodiment, the elastomer is manufactured by the Pahli Resin Chemical Co., Ltd., Taichung Hsian, Taiwan, R.O.C. and is described as having a density of 10.9 lbs. The sponge conforms to substantially any hand and prevents the hand from becoming sore when the massager is held for long periods of time.

Figure 5:
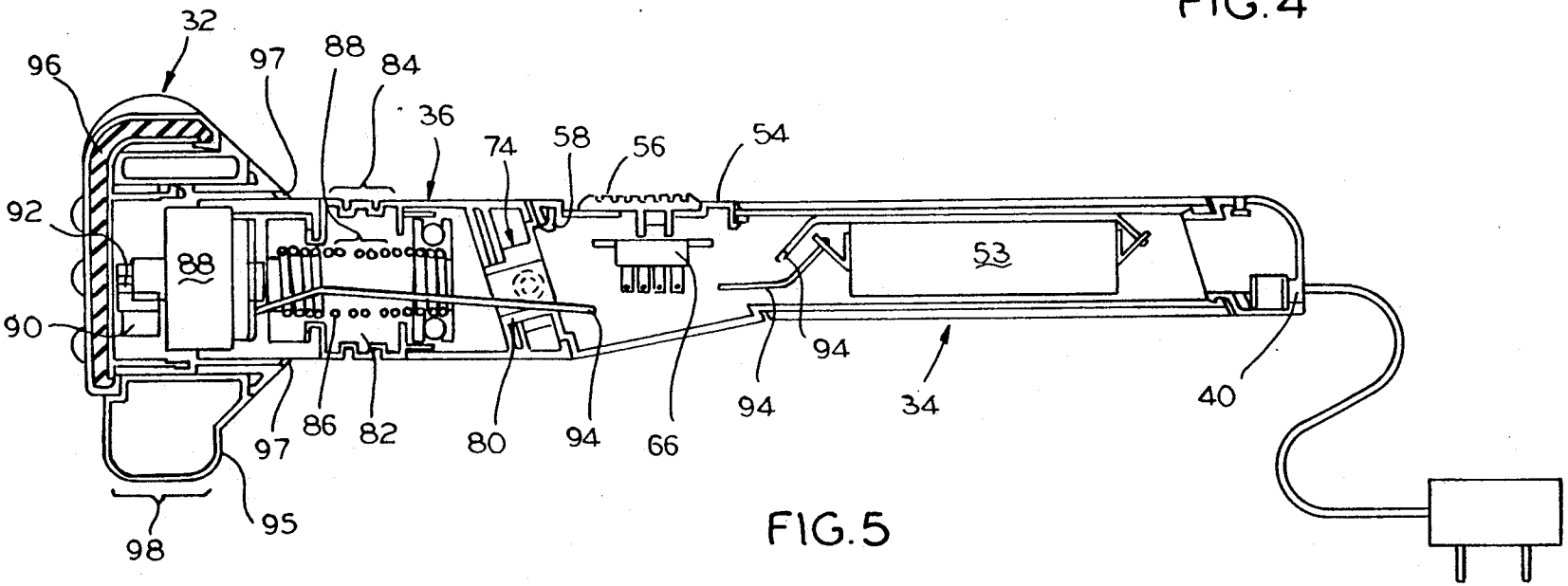
FIG. 5 is a side elevation view, in cross section, of the massager with the handle set in a straight configuration.
Figure 6:
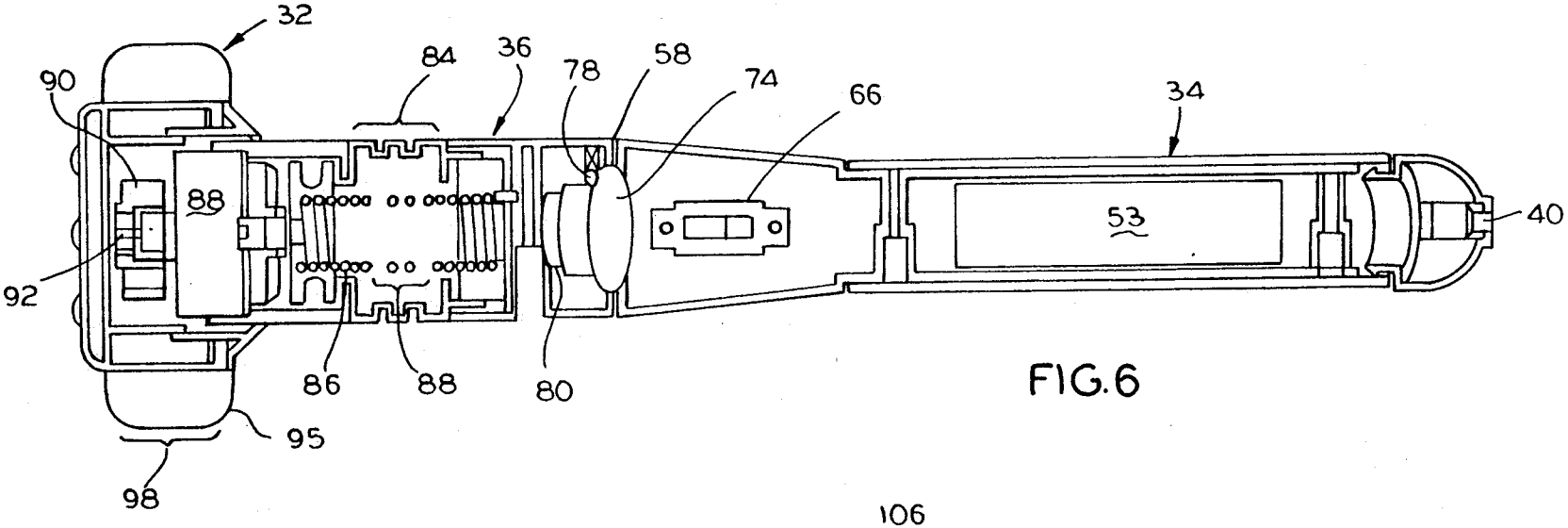
FIG. 6 is a top plan view, in cross section, of the massager.
Figure 9:
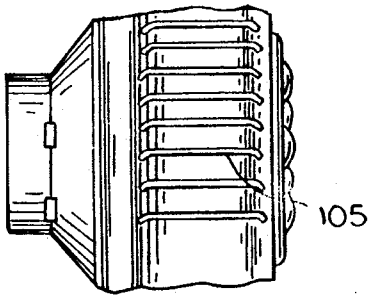
FIGS. 7–11 are five different surface contours which may be pressed against the body.

In the end of the handle, an opening 40 represents means for giving access for either an A.C. power cord or a jack for a battery charging adapter 41 (FIG. 5). Any of a plurality of different end caps 43 may be selected to construct an A.C., battery, or combined A.C. and battery structure. The end cap 43A (FIG. 5A) for A.C. power has a power cord passing through an opening 40, with strain relief 47 therein. The end cap 43B (FIG. 5) for battery operation has a jack 49 for receiving the plug of an A.C. battery charger 51. An on or off, and power level selector switch 42 controls the massager. An LED 43 lights when the massager batteries 53 are being recharged. Of course, no batteries are provided when the massager is configured for A.C. operation.

Means are provided for adjusting the configuration of handle 34. In greater detail, both the tubular grip section 34 and the offset section 36 end at complementary slanted surfaces 46, which may slant (angle B, FIG. 1) in the order of 45°-80° (75° preferred) with respect to the axis of tubular grip section 34, or the axis of offset section 36. When the offset section 36 is twisted in one direction relative to the grip section 34, the grip 34 and offset section 36 are in a straight alignment, as best seen in FIG. 5. When section 36 is twisted to its maximum position in another direction (best seen in FIG. 1), the two parts 34, 36 are offset from each other by an angle A, which may be in the order of 90°-160°(150° preferred). Between the extreme positions shown in FIGS. 1, 5, there are any suitable number of intermediate positions. The bellows 38 enables the vibrating head 32 to vary its position in some small degree from whatever angle is selected by twisting part 36 relative to part 34 in order to adjust the minor misalignments between the vibrating head and the body surface.

The construction of the massager, in general, and the vibrating head specifically will become more apparent from a study of FIGS. 2-6.

Figure 2:
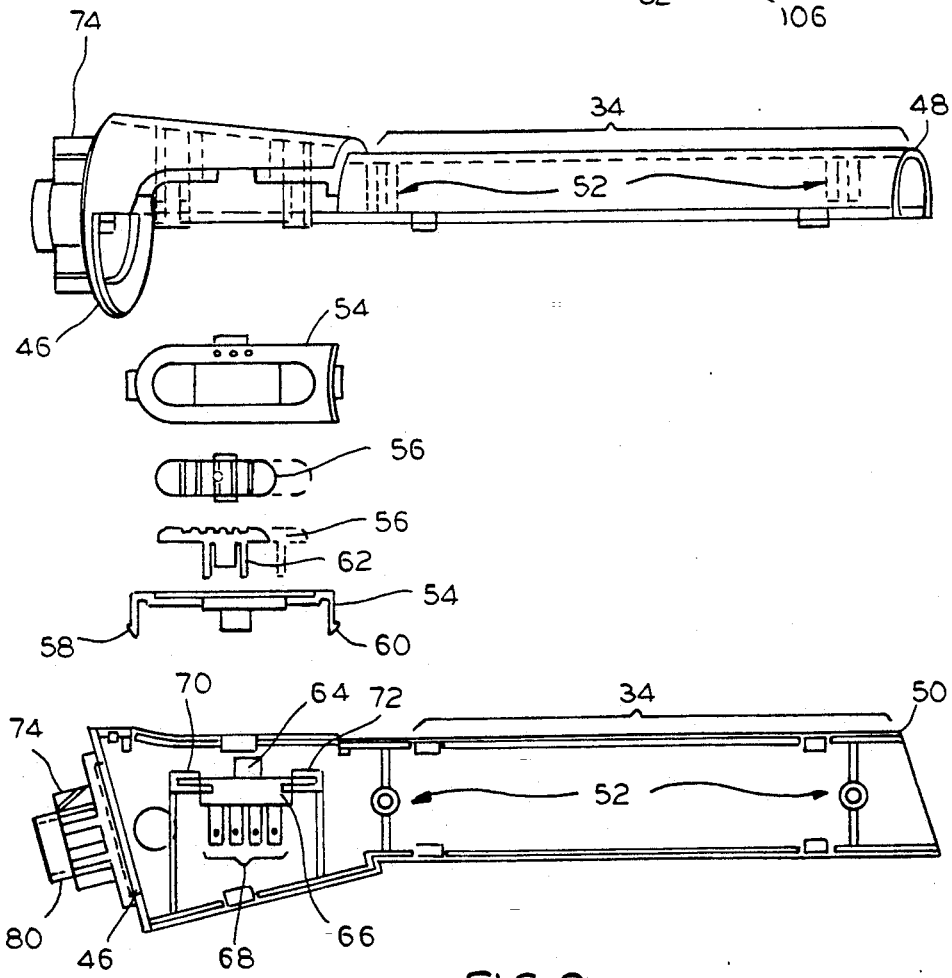
FIG. 2 is an exploded view of the grip portion of the massager.

FIG. 2 is an exploded view of the grip portion 34 of the massager which comprises two half shells 48, 50 that come together and are bonded in a face to face contact. A battery compartment 52 may hold a rechargeable nickel cadmium battery 53 (FIGS. 5, 6), when it is provided (i.e. it is provided in the battery driven model, but not in the A.C. driven model).

Figure 3:
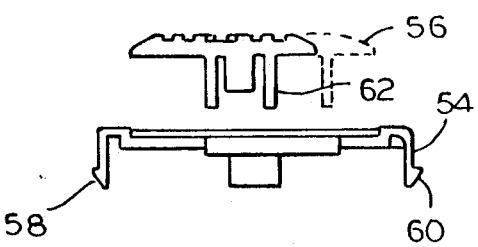
FIG. 3 is a side elevation of a switch that may be used to turn the massager on or off and to select one of many power levels.

FIG. 3 showns a switch plate 54 which is captured between the two housing shells 48, 50, when they are put together. The switch plate 54, shown in side elevation, has a pair of end hooks 58, 60 which aid in the capture of the plate in a firmly secured position within the body shell. The switch control member 56 is a plate having a number of dependent arms 62 which fit over a button 64 (FIG. 2) on a slide switch 66. Four or more electrical terminals 68 (FIG. 2) depend from the slide switch in order to make electrical connections which select between on/off and power level conditions. Switch 66 is held in place by guides 70, 72 which are integrally molded into the body shell.

Figure 4:
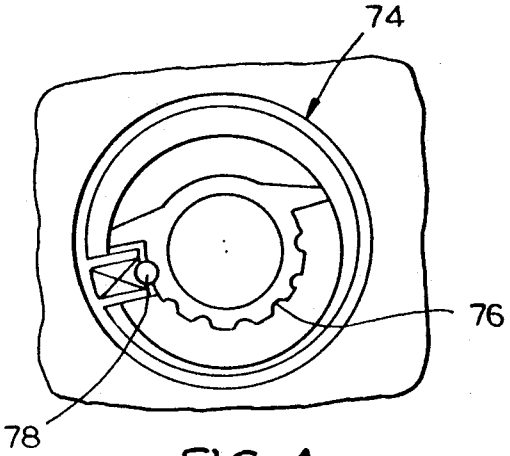
FIG. 4 is a plan view of a position selecting detent mechanism.

Mounted on the angled end 46 of grip 34 is a detent assembly 74 which is best shown in detail in FIG. 4. More specifically, a plastic plate 74 has a series of indentations 76 formed around approximately 180° of its surfaces. A spring biased ball detent 78 is positioned to move into and out of these indentations, locking the plate 74 in the selected position. The indented plate 74 is secured to the grip housing part 34. The part with the ball detent 78 is secured to the offset housing part 36 in order to provide click stops for holding the offset part in a selected position.

A projection 80 (FIG. 2) on the indented plate 74 forms an axle on which the offset part 36 may pivot or turn, the axis of rotation being shown at 82 (FIG. 5) as an angle C, in the order of 15°.

The internal construction of the offset part 36 (FIGS. 5, 6) includes a flexible bellows 84 which provides a limited degree of flexing to the vibrating head 32. A differential coiled spring 86 extends throughout the flexible bellows area. The differential action provides a relatively high degree of flexibility in the area of the widely spaced spring coils 88, and provides progressively greater rigidity in the area of the narrowly spaced coils in the remaining areas of the spring and on opposite ends of the widely spaced coils 84. The spring action is such that, within a limited range, the surfaces of the vibrating head 32 may move to almost any suitable position, thus accomodating itself to the body contour. Outside this range, there is a progressively greater resistance to such accomodating motion.

On the end of the handle, a motor 89 has an eccentric weight 90 attached to its shaft 92. As the motor runs, the eccentric weight rotates to generate vibrations, thereby shaking the vibrating head 32. The electrical wires 94 are here shown discontinuously so that they will not cover other parts in the drawing.

The vibrating head includes a disk shaped plastic cap 95 having any suitable internal ribs to provide greater physical strength. The disk has a flat end surface area with a peripheral area which extends somewhat perpendicularly therefrom. A suitable material is sold by the Suhhae Ind. Co. Ltd. under the trademark Glad No. SR-8000. The manufacturer describes this material as follows:

SPECIFIC GRAVITY: 0.87~1.16
HARDNESS: A45~85

A number of openings 97 cooperate with the internal ribs in order to form passageways that are useful for cooling the internal portions of the disk-shaped vibrating head cap 95. As the motor 89 turns, the eccentric weight 90 draws cooling air into and expels hot air from these internal passage ways. A relatively thick plastic blanket 96 covers the end face and a portion of the periphery of the plastic cap. The rest of the plastic cap has surface protuberances and indentations which provide different massaging effects somewhat similar to the effects which a masseur might produce by changing the shape of his hands.

Figure 10:
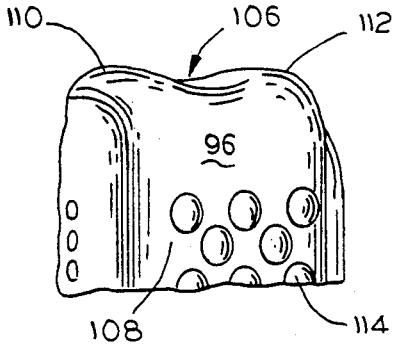
Figure 11:
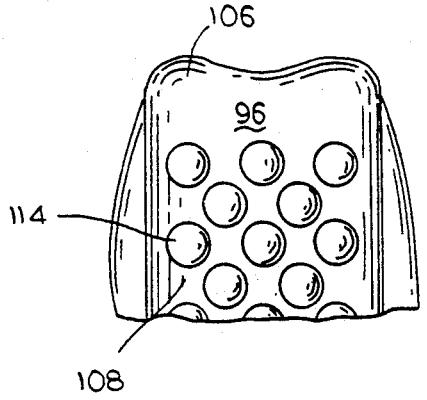

These vibrator shapes are shown in FIGS. 7-11. The shapes of FIGS. 7-10 are at a plurality of discrete locations distributed around the periphery 98 of the disk or cap 95; the shape of FIG. 11 is on the end face of the disk-shaped cap.

Figure 7:
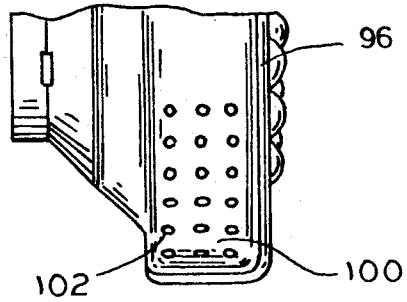

More particularly, FIG. 7 shows a hard, generally flat area 100 having a plurality of dimples 102 arranged in the form of a field of rows and columns distributed over the surface thereof. This surface provides a strong and steady rhythmic massage giving a soothing "touching and feeling" sensation which tends to sooth away tension.

At another location (FIG. 8) on periphery 98 of the disk shaped cap 95 is a field of small hard nodules 104, arranged in rows and columns. The nodules are projecting tips that produce tingling and pulsating sensations which are somewhat similar to a finger tip massage.

At yet another location (FIG. 9) on periphery 98 are a series of spaced parallel grooves or striations 105 forming a surface which may be held firmly against the sinews of aching muscles in order to relieve tiredness and pain.

FIGS. 10, 11 show a somewhat rigid, but still flexible, blanket 96 which extends over the flat end face 108 of the disk and onto a peripheral position 106 of the disk. The peripheral position 106 has a somewhat saddle shape comprising a concave shape 107 between two relatively high surfaces 110, 112. The concave portion 107 of this saddle shape would tend to surround a muscle or other similar body contour as if it were squeezing it. Also, the high surfaces 110, 112 would provide two locations which would press against a flat surface somewhat in the manner that the heel of an open hand would press. The flat end face 108 has a field of fairly large bumps 114 distributed in rows and columns. These bumps cover a relatively large area and provide a somewhat kneading action.

Figure 12:
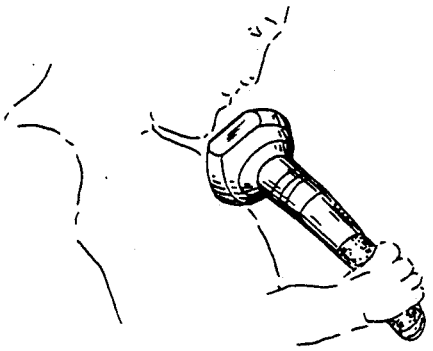

FIGS. 12–15 illustrate the operation of the massager. In FIG. 12, the handle and offset part are turned to a relatively small angular displacement. The person is holding the muscle relaxer surface of FIG. 7 against a muscle.

Figure 13:
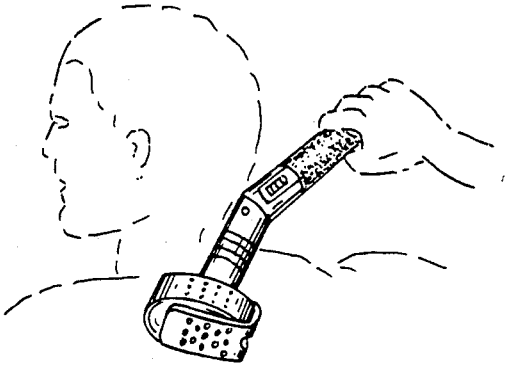
FIGS. 12–15 are views of the massager in operation which show how the angle of the handle may be adjusted to reach different body parts.

In FIG. 13, the offset part is set at a maximum angle. The user is holding a disk surface against a muscle on his back. The angle allows the user to apply considerable pressure against the muscle while holding the massager in a comfortable manner.

Figure 8:
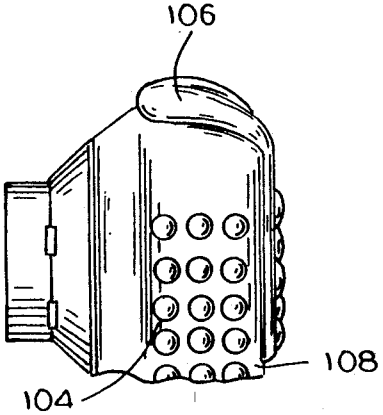
Figure 14:
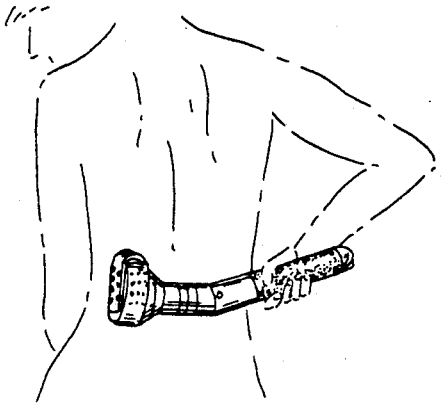

In FIG. 14, the user has placed the offset part 36 at the maximum angle to hold the surface of FIG. 8 against the small of the back. The angle enables the user to reach the spot without having to twist her arms to an uncomfortable position.

Figure 15:
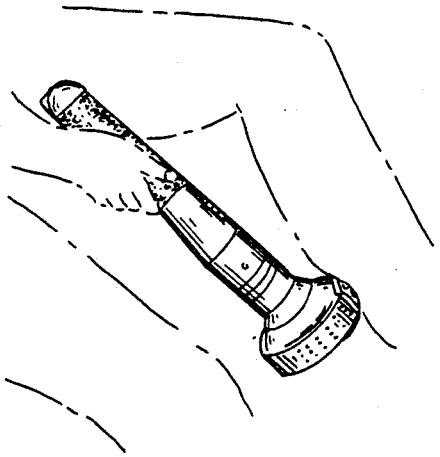

In FIG. 15, the offset part 36 is twisted to provide a straight wand. The saddle shape of FIG. 10 is being held against the contour of the calf of the leg.

These are only a few exemplary uses of the inventive wand massager. Those who use it may find many other ways of doing so.

Those who are skilled in the art will readily perceive how to modify the invention. Therefore, the appended claims are to be construed to cover all equivalent structures which fall within the true scope and spirit of the invention.

The claimed invention is:

1. The wand massager comprising a handle having an offset section and a grip section which are interconnected to pivot relative to each other, the handle being formed into a configuration extending between straight and angular in response to a rotation about said pivot of said grip and offset sections, a disk shaped vibrating head on an end of said handle, a vibrator inside said disk, said vibrator comprising a motor driving an eccentric weight, and passageways within said disk for drawing cooling air into and expelling hot air from said disk in response to said motor driving said eccentric weight.

2. The wand massager of claim 1 wherein said disk has a face surface surrounded by a peripheral surface with a plurality of different contours formed in different areas thereon in order to perform different massaging actions when individual ones of said contours are held against a body while said motor is running.

3. A wand massager comprising a handle having an off set section and a grip section which are interconnected to pivot relative to each other, the handle being formed into a configuration extending between straight and angular in response to a rotation about said pivot of said grip and offset sections, a disk shaped vibrating head on an end of said handle, a vibrator inside said disk, said vibrator comprising a motor driving an eccentric weight, passageways within said disk for drawing cooling air into and expelling hot air from said disk in response to said motor driving said eccentric weight, said disk having a face surface surrounded by a peripheral surface with a plurality of different contours formed in different areas thereon in order to perform different massaging actions when individual ones of said contours are held against a body while said motor is running, and a blanket of somewhat rigid but still flexible material extending over the face of said disk and down over one of said contours in one of said areas on the peripheral surface of said disk, said contour having a somewhat saddle shape in the form of a concave area between two relatively high surfaces.

4. The wand massager of claim 3 wherein one of said contours is a generally flat area having a field of dimples formed in rows and columns over one of said areas of the peripheral surface of said disk.

5. The wand massager of claim 3 wherein one of said contours is a series of spaced parallel striations formed on one of said areas of the peripheral surface of said disk.

6. The wand massager of claim 3 wherein one of said contours is a generally flat area with a field of small nodules arranged in rows and columns over one of said areas of the peripheral surface of said disk, said nodules projecting outwardly and away from the peripheral surface of said disk.

7. The wand massager of claim 3 wherein said blanket has a field of large bumps arranged in rows and columns over said face of said disk.

8. The wand massager of claim 3 and a soft covering on said grip section to facilitate a holding thereof.

9. A wand massager comprising a handle having an offset section and a grip section which are interconnected to pivot relative to each other, the handle being formed into a configuration extending between straight and angular in response to a rotation about said pivot of said grip and offset sections, a disk shaped vibrating head on an end of said handle, a vibrator inside said disk, said vibrator comprising a motor driving an eccentric weight, and passageways within said disk for drawing cooling air into and expelling hot air from said disk in response to said motor driving said eccentric weight, said disk having a face surface surrounded by a peripheral surface with a plurality of different contours formed in different areas thereon in order to perform different massaging actions when individual ones of said contours are held against a body while said motor is running, one of said contours being a generally flat area having a field of dimples formed in rows and columns over one of said areas of the peripheral surface of said disk; a second of said contours being a series of spaced parallel striations formed on a second of said areas of the peripheral surface of said disk; a third of said contours being a generally flat area with a field of small nodules arranged in rows and columns over a third of said areas on the peripheral areas of the peripheral surface of said disk, said nodules projecting away from the peripheral surface of said disk; and a fourth of said contours including a blanket of fairly rigid but flexible material extending over the face of said disk and down over said fourth of said contours on a fourth of said areas on the peripheral surface of said disk, said fourth contour being a somewhat saddle shape formed by a concave area between two high surfaces, and said blanket on said face of said disk having a field of large bumps arranged in row and columns which project away from the surface of the face of said disk.

10. The wand massager of claim 9 and a rechargeable battery in said handle for driving said motor, and adapter means for charging said battery in response to an energization thereof by an A.C. power source.

11. A massager comprising an elongated handle having two pivotally joined parts, one of said pivotally joined parts having first axis of rotation extending parallel to the elongation of said handle, the other of said two pivotally joined parts having a second axis of rotation which is angularly offset from said first axis by an amount which enables said two parts to be rotated to anyone of a given plurality of different configurations to cause said parts to form a handle which is selectively adjustable over a range from a straight handle to an angular handle, said handle terminating at one end in a disk having a thickness which provides a surface at the periphery of said disk, said peripheral surface being substantially perpendicular to a face surface on said disk, means for rotating said one part of said handle relative to the other part of said handle to any of many discrete locations, and means on said flat surface and on said perpendicular peripheral surface for giving a plurality of different massaging effects.

12. The massager of claim 11 and a flexible section between said handle and said disk for enabling said disk to flex relative to said handle in order to fit against and accommodate itself to a surface of a body.

13. The massager of claim 11 wherein said pivot is offset relative to one of said handle parts which is gripped, said offset having a maximum angle in the order of approximately 120°–160°.

14. The massager of claim 13 wherein said angle is 150°.

15. The massager of claim 11 wherein said disk has at least three different contours formed in different areas around the periphery thereof in order to perform different massaging actions when individual ones of said contours are held against a body while said motor is running.

16. A massager comprising an elongated handle having two pivotally joined parts, said pivot being set an angle relative to the elongation of said handle, said angle enabling said two joined parts to be rotated on said pivot to any selected one of a given plurality of different configurations ranging from a straight handle to an angular handle, said handle terminating at one end in a disk having a thickness which provides a surface at the periphery of said disk, said peripheral surface being substantially perpendicular to a face surface on said disk, means for rotating one part of said handle relative to the other part of said handle to any of many discrete locations, means on said flat surface and on said perpendicular peripheral surface for giving a plurality of different massaging effects, and detent means associated with said pivot, said plurality of handle configurations being click stops set by said detent means in response to a twisting of said two parts relative to each other.

17. The massager of claim 16 and a soft covering over one part of said handle where said handle is gripped.

18. A massager comprising a motor, an elongated handle having two pivotally joined parts, said pivot being set at an angle relative to the elongation whereby said handle may be given a plurality of different configurations ranging from straight to an angular handle, means for rotating one part of said handle relative to the other part of said handle to any of many discrete locations, said handle terminating at one end in a disk having a thickness which provides a surface at the periphery of said disk, said peripheral surface being substantially perpendicular to a face surface on said disk, said disk having a plurality of different contours formed in different areas thereon in order to perform different massaging actions when individual ones of said contours are held against a body while said motor is running, one of said counts being a generally flat area having a field of dimples formed in rows and columns over one of said areas of the peripheral surface of said disk; a second of said contours being a series of spaced parallel striations formed on a second of said areas on the peripheral surface of said disk; a third of said contours being a generally flat area with a field of small nodules arranged in rows and columns over a third of said areas of the peripheral surface of said disk, each of said small nodules projecting away from the peripheral surface of said disk; and a fourth of said contours includes a blanket of fairly rigid but flexible material extending over the face of said disk and down over said fourth of said contours on a fourth of said areas on the peripheral surface of said disk, said fourth contour being somewhat saddle shape comprising a concave area between two high surfaces, said blanket on said face of said disk having a field of a large bumps arranged in a row and columns which project away from the surface of the face of said disk.

19. The massager of claim 18 and a soft covering on said grip section to facilitate a holding thereof.

20. The massager of claim 19 and a rechargeable battery in said handle for driving said motor, and adapter means for charging said battery in response to an energization thereof by an A.C. power source.

* * * * *